United States Patent [19]

Smith

[11] Patent Number: 4,783,661

[45] Date of Patent: Nov. 8, 1988

[54] DUAL-BAND CIRCULARLY POLARISED ANTENNA WITH HEMISPHERICAL COVERAGE

[75] Inventor: Martin S. Smith, Chelmsford, Great Britain

[73] Assignee: STC Plc, London, England

[21] Appl. No.: 102,715

[22] Filed: Sep. 30, 1987

[30] Foreign Application Priority Data

Nov. 29, 1986 [GB] United Kingdom ..... 8628599

[51] Int. Cl.[4] ..... H01Q 1/38

[52] U.S. Cl. ..... 343/700 MS; 343/830

[58] Field of Search ..... 343/700 MS, 829, 846, 343/848, 767, 830

[56] References Cited

U.S. PATENT DOCUMENTS 4,070,676 1/1978 Sanford ..... 343/829

4,089,003 5/1978 Conroy ..... 343/700 MS

FOREIGN PATENT DOCUMENTS 2067842 7/1981 United Kingdom ..... 343/700 MS

OTHER PUBLICATIONS

Sanford et al., "Recent Developments in the Design of Conformal Microstrip Phased Arrays", IEEE Conf. on Maritime and Aeronautical Satellite Communications and Navigation, 7-9 Mar. 1978, IEEE Conf. Pub. No. 160, pp. 105-108.

*Primary Examiner*—William L. Sikes

*Assistant Examiner*—Michael C. Wimer

*Attorney, Agent, or Firm*—Lee & Smith

[57] ABSTRACT

A circularly polarized antenna including first and second multiple patch antenna structures dimensioned to operate at two distinct frequencies, each antenna structure consisting of four shorted patches, the patches of the first structure being spaced from a ground plane by dielectric material, the patches of the second structure being spaced from the patches of the first structure by dielectric material, the patches of the second structure each overlying a corresponding patch of the first structure and each having a dimension $\lambda_m^{(2)}/4$ which is less than the dimension $\lambda_m^{(1)}/4$ of the corresponding patch of the first structure, with feed means for each of the patches, the patches of both structures being disposed in the planes of the patches so that the radiating edges of the two patch structures form superimposed antenna structures.

3 Claims, 1 Drawing Sheet

DUAL-BAND CIRCULARLY POLARISED ANTENNA WITH HEMISPHERICAL COVERAGE

BACKGROUND OF THE INVENTION

This invention relates to a dual-band circularly polarised antenna with hemispherical coverage.

There are many applications, particularly for aircraft, where compact low profile antennas are required. Preferably such antennas should be flush with, or nearly so, the supporting surface.

RELATED ART

The use of microstrip antenna structures is known. James J. R. et al describe in "Microstrip Antenna Theory & Design", Peter Peregrinus Ltd., 1981, the use of a shorted microstrip patch to create an antenna structure. A patch of conductor material, typically copper, is formed on one face of a dielectric spacer the other face of which carries a ground plane conductor. The patch is shorted along one edge portion to the ground plane either by a conductive 'wall' or by a row of conductive pins. The feed to the patch can conveniently be by coaxial conductor passing through the ground plane.

In many applications there is a requirement for a circularly polarised antenna. One structure which meets this requirement is a cavity backed crossed slot antenna, which can provide circular polarisation with hemispherical coverage (ideally 5dBic normal to the plane of the slots, reducing to −1dBic in the plane of the slots). The two orthogonal slots are fed in phase quadrature. In one approach the slots are fed with 0° and 90° phase, with symmetrical amplitude excitation. In another approach four feeds are used, spaced 90° apart in angle and fed with 0°, 90°, 180° and 270° of phase respectively. Such an arrangement, using hybrids to provide the feeds, is disclosed by King H. E. et al, "A shallow ridged cavity crossed slot antenna for the 240 to 400 MHz frequency range", IEEE Transactions, AP-23, pp 687–689, September 1975.

Another known crossed slot antenna is constructed of four rectangular microstrip patches each of length $\lambda_m/4$ from the shorted edge, the four patches being fed with 0°, 90°, 180° and 270° of phase respectively. These antennas radiate in a narrow frequency band determined by the length $\lambda_m/4$, where $\lambda_m$ is the wavelength in the dielectric material.

Also known is a concept for making a dual frequency microstrip patch antenna, utilising the so-called 'piggyback' structure as disclosed by James J. R. et al, supra, and Jones H. S., "Some novel design techniques for conformal antennas," Proc. IEE Int. Conf. on Ant. and Prop., London, pp 448–452, 1978. A $\lambda_m^{(1)}/4$ shorted patch is carried above and shorted to a $\lambda_m^{(2)}/2$ open patch which in turn is carried above the ground plane.

SUMMARY OF THE INVENTION

According to the present invention there is provided a circularly polarised antenna including first and second multiple patch antenna structures dimensioned to operate at two distinct frequencies, each antenna structure consisting of a like plurality of patches of electrically conductive material, the patches of the first structure being spaced from a ground plane by dielectric material, the patches of the second structure being spaced from the patches of the first structure by dielectric material, the patches of the second structure each overlying a corresponding patch of the first structure and each having a dimension $\lambda_m^{(2)}/4$ which is less than the dimension $\lambda_m^{(1)}/4$ of the corresponding patch of the first structure, with feed means for each of the patches, the patches of both structures being disposed in the planes of the patches so that the radiating edges of the two patch structures form superimposed antenna structures.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
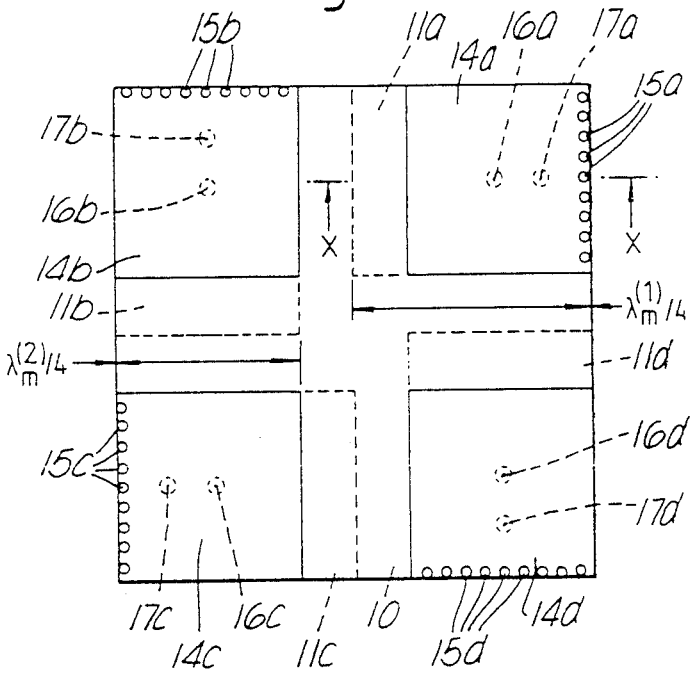
FIG. 1 is a plan view of a dual band circularly polarised antenna.
Figure 2:
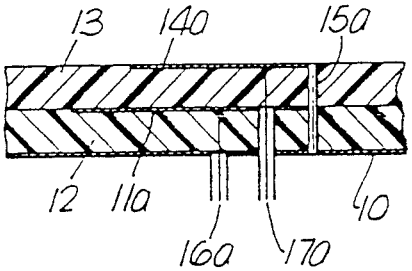
FIG. 2 is a cross-section elevation on the line XX of FIG. 1.

The dual-band antenna illustrated comprises two crossed slot antennas superimposed on a common ground plane 10. The first crossed slot antenna is formed of a set of four patches 11*a*–11*d* having effective lengths $\lambda_m^{(1)}/4$ arranged in rotation so that their radiating edges form the crossed slot structure. Conveniently the patches 11*a*–11*d* are copper foil carried on one face of a sheet of dielectric material 12 the other face of which carries the ground plane copper foil 10. Superimposed on the first antenna is a second dielectric sheet 13 carrying a second set of four copper foil patches 14*a*–14*d*, aligned with the first set of patches. The patches 14*a*–14*d* each have an effective length of $\lambda_m^{(2)}/4$, where $\lambda_m^{(1)}$ is greater than $\lambda_m^{(2)}$. Both sets of patches are shorted to the ground plane 10 by common sets of shorting pins 15*a*–15*d*. The patches of the first set are fed by respective coaxial feeds 16*a*–16*d* the outer conductors of which are connected to the ground plane. The patches of the second set are fed by respective coaxial feeds 17*a*–17*d* the outer conductors of which pass through the ground plane and are connected to both the ground plane and the patches of the first set. It is to be noted that the radiating edges of each stacked pair of patches are arranged so that the top patch does not obstruct the radiation from the bottom patch.

For the example illustrated, with a difference between frequency $f_1$ and $f_2$ of 30% approximately, where $f_2$ is higher than $f_1$ (with corresponding wavelengths $\lambda_m^{(2)}$ and $\lambda_m^{(1)}$ the common shorting plane, using either a row of metal pins as illustrated or a continuous metal strip, can be used, having the radiating edges appropriately placed with respect to each other and to the centre lines of the crossed slot. For other frequency separations separate shorting planes might be preferred. Alternatively, microstrip substrates with different dielectric constants could be used to alter the relative patch lengths involved (approximately equal to $\lambda_m^{(1)}/4\sqrt{\epsilon_1}$ and $\lambda_m^{(2)}/4\sqrt{\epsilon_2}$).

The lateral dimensions of the antenna are governed by $\lambda_m^{(1)}$ (the larger wavelength) and $\epsilon r$ (the relative permittivity) of the microstrip substrate.

The approximate size of the square side of the structure is approximately $\lambda_m^{(1)}/2\sqrt{\epsilon_r}$. The exact size is determined by the width chosen for the patches and the "slot" width (i.e. the separation between adjacent patch edges).

The thickness of the antenna is related to the required bandwidths at the two frequencies $f_1$ and $f_2$. With a simple feed probe connected directly to the patch, very thin substrates (height considerably less than patch dimensions) imply bandwiths of a very few per cent. Thicker substrates offer bandwidths approximately 5%–10%, or greater if broadbanding techniques are used.

Whilst the particular embodiment described utilises crossed slot structures it will be appreciated that other multiple patch antenna structures can also be constructed in a superimposed arrangement to achieve a dual band antenna with circular polarisation.

It is claimed:

1. A circularly polarised dual frequency antenna structure comprising:

a first microstrip crossed slot antenna composed of four identical rectangular patches of electrically conductive material arranged symmetrically and dimensioned to operate at a first frequency, a second microstrip crossed slot antenna composed of four identical rectangular patches of electrically conductive material arranged symmetrically and dimensioned to operate at a second, higher frequency, a conductive ground plane, wherein said first antenna is parallel to and spaced from said ground plane by dielectric material and said second antenna is parallel to and spaced from said first antenna by dielectric material, said second antenna lying atop said first antenna, the slots of said first and second antennae being aligned, individual coaxial feed means for each of the patches in said first antenna, said feed means for the first antenna having outer conductors electrically connected to the ground plane and inner conductors electrically connected to the respective patches of the first antenna, individual coaxial feed means for each of the patches in said second antenna, said feed means for the second antenna having outer conductors passing through the ground plane and electrically connected to both the ground plane and the corresponding patches of the first antenna and inner conductors electrically connected to the respective patches of the second antenna, and shorting means arranged to short a corresponding one edge of each patch of both first and second antennae to the ground plane, said corresponding edges of the patches of the second antenna being aligned with the corresponding edges of the first antenna, said corresponding edges being remote from the radiating edge defining the crossed slots .

2. A circularly polarised dual frequency antenna structure as claimed in claim 1 wherein said shorting means are sets of conductive pins, each set electrically connecting the respective patch edge to the ground plane.

3. A circularly polarised dual frequency antenna structure as claimed in claim 1 wherein said shorting means are formed by electrically conductive planes extending from the respective patch edges to the ground plane.

* * * * *